US011229281B2

(12) United States Patent
Jimenez et al.

(10) Patent No.: US 11,229,281 B2
(45) Date of Patent: Jan. 25, 2022

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Robert Moskovich, East Brunswick, NJ (US); Roger Kirchhofer, Lucerne (CH); Kurt Bieri, Lucerne (CH)

(73) Assignee: Colgate-Palmolive Company, New York, NY (US)

( * ) Notice: Subject to any disclaimer, the term of this patent is extended or adjusted under 35 U.S.C. 154(b) by 1005 days.

(21) Appl. No.: 15/539,425

(22) PCT Filed: Dec. 23, 2014

(86) PCT No.: PCT/US2014/072075
§ 371 (c)(1),
(2) Date: Jun. 23, 2017

(87) PCT Pub. No.: WO2016/105374
PCT Pub. Date: Jun. 30, 2016

(65) Prior Publication Data

US 2017/0354241 A1 Dec. 14, 2017

(51) Int. Cl.
*A46B 9/04* (2006.01)
*A46B 9/02* (2006.01)
(Continued)

(52) U.S. Cl.
CPC ..... *A46B 9/04* (2013.01); *A46B 9/028* (2013.01); *A46B 9/06* (2013.01); *A46B 15/0081* (2013.01); *A46B 2200/1066* (2013.01)

(58) Field of Classification Search
CPC ..... A46B 15/0081; A46B 9/026; A46B 9/028; A46B 9/04; A46B 9/06
See application file for complete search history.

(56) References Cited

U.S. PATENT DOCUMENTS 758,764 A 5/1904 MacLeod
846,900 A 3/1907 Bloom
(Continued)

FOREIGN PATENT DOCUMENTS

AR 71556 10/2003
AR 80042 11/2009
(Continued)

OTHER PUBLICATIONS

International Search Report and the Written Opinion issued in International Application PCT/US2010/046806 dated Mar. 16, 2011.
(Continued)

*Primary Examiner* — Orlando E Aviles
*Assistant Examiner* — Makena S Markman

(57) ABSTRACT

An oral care implement having tooth cleaning elements and an elastomeric soft tissue cleanser. In one aspect, the oral care implement has a handle and a head (110) coupled to the handle, an elastomeric soft tissue cleanser having a plurality of protuberances (152) extending from a rear surface of the head (110), and a plurality of tooth cleaning elements (115) extending from a front surface of the head. The protuberances (152) of the elastomeric soft tissue cleanser collectively define a convex longitudinal side profile and comprise at least one convex transverse top profile. The plurality of tooth cleaning elements (115) collectively define a concave longitudinal side profile and comprise at least one concave transverse top profile.

20 Claims, 8 Drawing Sheets

(51) Int. Cl.
*A46B 9/06* (2006.01)
*A46B 15/00* (2006.01)

(56) References Cited

U.S. PATENT DOCUMENTS 1,125,532 A 1/1915 Himmel
1,369,966 A 3/1921 Cosens et al.
1,901,230 A 3/1933 Palmer
1,924,152 A 8/1933 Coney et al.
2,161,349 A 6/1939 Hadden
2,186,005 A 1/1940 Casto
2,305,461 A 12/1942 Spyra
D273,635 S 5/1984 Stocchi
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
5,655,249 A 8/1997 Li
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A 9/1998 Dawson et al.
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A 10/1999 Inns et al.
5,984,935 A 11/1999 Budei et al.
5,991,958 A 11/1999 Hohlbein
6,006,394 A * 12/1999 Bredall ..... A46B 9/026 15/167.1
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,219,874 B1 4/2001 Van Gelder et al.
6,234,798 B1 5/2001 Salazar et al.
6,276,021 B1 8/2001 Hohlbein
6,292,973 B1 9/2001 Moskovich et al.
D450,457 S 11/2001 Hohlbein
D450,929 S 11/2001 Angelini et al.
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S 4/2005 Desalvo
6,886,207 B1 5/2005 Solanki
6,889,405 B2 5/2005 Ritrovato et al.
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
6,988,777 B2 * 1/2006 Pfenniger ..... A46B 3/06 15/167.1
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 * 8/2006 Hohlbein ..... A46B 9/028 15/110
D527,528 S 9/2006 Hohlbein
D528,803 S 9/2006 Hohlbein
D532,202 S 11/2006 Hohlbein
D532,607 S 11/2006 Hohlbein
7,143,462 B2 * 12/2006 Hohlbein ..... A46B 9/026 15/111
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.

(56) References Cited

U.S. PATENT DOCUMENTS

D623,415 S 9/2010 Geiberger
7,788,756 B2 9/2010 Kraemer
7,845,042 B2 12/2010 Moskovich et al.
7,854,036 B2 12/2010 Georgi
7,937,794 B2 5/2011 Huber et al.
7,954,191 B2 6/2011 Hohlbein
7,958,589 B2 6/2011 Braun et al.
7,975,343 B2 7/2011 Hohlbein et al.
7,975,346 B2 7/2011 Moskovich et al.
7,979,947 B2 7/2011 Storkel et al.
8,032,991 B2 10/2011 Lawless
8,042,217 B2 10/2011 Sorrentino
8,046,864 B2 11/2011 Baertschi et al.
8,060,970 B2 * 11/2011 Solanki ..... A46B 9/028 15/110
8,060,972 B2 11/2011 Geiberger et al.
8,083,980 B2 12/2011 Huber et al.
8,239,996 B2 8/2012 Garber et al.
8,240,936 B2 * 8/2012 Vazquez ..... A46B 15/0032 401/282
8,307,488 B2 11/2012 Pfenniger et al.
8,327,492 B2 12/2012 Cann
8,332,982 B2 12/2012 Braun et al.
8,332,985 B2 12/2012 Solanki
8,382,208 B2 * 2/2013 Baertschi ..... A46B 5/0025 15/143.1
8,448,284 B2 5/2013 Gross et al.
8,448,287 B2 5/2013 Ponzini et al.
8,458,846 B2 6/2013 Schamberg et al.
8,484,789 B2 7/2013 Claire-Zimmet et al.
8,500,766 B2 8/2013 Jimenez et al.
8,528,148 B2 9/2013 Brown, Jr. et al.
8,595,886 B2 12/2013 Edelstein et al.
8,601,635 B2 12/2013 Goldman et al.
8,608,251 B2 12/2013 Nirwing et al.
8,621,698 B2 1/2014 Chenvainu et al.
8,631,534 B2 1/2014 Blanchard et al.
8,732,890 B2 5/2014 Mohr et al.
8,739,351 B2 6/2014 Kling et al.
8,776,302 B2 7/2014 Baertschi et al.
8,806,695 B2 8/2014 Russell
8,813,292 B2 8/2014 Driesen et al.
9,167,888 B2 10/2015 Moskovich
9,173,479 B2 * 11/2015 Butz ..... A46B 9/04
9,578,956 B2 * 2/2017 Sedic ..... A46B 9/04
9,585,464 B2 * 3/2017 Moskovich ..... A46B 5/0025
9,723,912 B2 * 8/2017 Chun ..... A46B 9/04
2001/0013151 A1 * 8/2001 Gelder ..... A46B 9/026 15/167.1
2002/0017003 A1 2/2002 Kramer et al.
2002/0138928 A1 10/2002 Calabrese
2003/0163881 A1 9/2003 Driesen et al.
2003/0178745 A1 9/2003 Scarabelli et al.
2003/0178885 A1 9/2003 Weihrauch
2004/0025275 A1 2/2004 Moskovich et al.
2004/0107521 A1 6/2004 Chan et al.
2004/0117934 A1 6/2004 Pfenniger et al.
2004/0134004 A1 7/2004 Kaleta
2004/0134007 A1 * 7/2004 Davies ..... A46B 15/0055 15/110
2005/0166343 A1 8/2005 Gavney, Jr.
2005/0210612 A1 9/2005 Hohlbein et al.
2006/0048314 A1 3/2006 Kressner
2006/0048323 A1 3/2006 Rueb
2006/0064827 A1 3/2006 Chan
2006/0123574 A1 6/2006 Storkel et al.
2006/0236477 A1 10/2006 Gavney, Jr.
2006/0236478 A1 10/2006 Hohlbein et al.
2006/0248667 A1 11/2006 Kraemer
2007/0151058 A1 7/2007 Kraemer et al.
2007/0169295 A1 7/2007 Winter et al.
2007/0265555 A1 11/2007 Deng
2007/0283517 A1 12/2007 Blanchard et al.
2009/0007357 A1 1/2009 Meadows et al.
2009/0025165 A1 1/2009 Moskovich et al.
2009/0038097 A1 2/2009 Geiberger
2009/0158543 A1 6/2009 Lee
2009/0255077 A1 10/2009 Mori et al.
2010/0043162 A1 2/2010 Kling et al.
2010/0058550 A1 3/2010 Ballmaier et al.
2010/0088836 A1 4/2010 Kirchhofer et al.
2010/0101037 A1 4/2010 Hilfiker et al.
2010/0115724 A1 5/2010 Huang
2010/0180392 A1 7/2010 Binet et al.
2010/0223746 A1 9/2010 Mueller
2010/0263149 A1 10/2010 Ballmaier et al.
2010/0306941 A1 12/2010 Erskine-Smith et al.
2011/0030160 A1 2/2011 Knutzen et al.
2011/0047736 A1 3/2011 Jimenez et al.
2011/0109149 A1 5/2011 Loetscher et al.
2011/0138560 A1 6/2011 Vitt et al.
2011/0152909 A1 6/2011 Jimenez et al.
2011/0219558 A1 9/2011 Vitt et al.
2012/0034576 A1 2/2012 Mostafa
2012/0192369 A1 8/2012 Mohr et al.
2013/0000658 A1 * 1/2013 Nguyen ..... A46B 15/0071 132/200
2013/0007968 A1 1/2013 Driesen et al.
2013/0036566 A1 2/2013 Schlatter
2013/0139338 A1 6/2013 Hess et al.
2013/0269128 A1 10/2013 Jimenez
2013/0291320 A1 11/2013 Kirchhofer et al.
2013/0333126 A1 12/2013 Miller
2014/0047656 A1 2/2014 Newman et al.
2014/0158152 A1 6/2014 Kirchofer et al.
2014/0173838 A1 6/2014 Dickie et al.
2014/0173853 A1 6/2014 Kirchhofer et al.
2014/0298605 A1 10/2014 Ivory
2014/0310901 A1 10/2014 Geiberger et al.
2017/0007284 A1 * 1/2017 Georgi ..... A46B 15/0081

FOREIGN PATENT DOCUMENTS

BR 7900283 8/2000
BR DI 6601454-9 4/2006
BR DI 6702593 8/2007
BR DI 6805210-3 11/2008
BR DI 6902120-1 5/2009
BR DI 6903329-3 8/2009
BR DI 6903330-7 8/2009
BR DI 6904386 11/2009
BR DI 7102178-7 4/2011
BR 30 2013 000448-1 2/2013
BR DI 6401609-9 5/2014
CH 215110 6/1941
CN 3372860D 6/2004
CN 3372861D 6/2004
CN 2732059 10/2005
CN 1713838 12/2005
CN 300704339 10/2007
CN 101119659 2/2008
CN 2011157105 Y 12/2008
CN 201294969 8/2009
CN 201312626 9/2009
CN 201518876 7/2010
CN 201518877 7/2010
CN 201518880 7/2010
CN 201528796 7/2010
CN 201541995 8/2010
CN 201541996 8/2010
CN 201541997 8/2010
CN 201550827 8/2010
CN 201617352 11/2010
CN 301406316 S 12/2010
CN 301421505 S 12/2010
CN 102076244 5/2011
CN 201814085 5/2011
CN 201879060 6/2011
CN 201986933 9/2011
CN 301763519 12/2011
CN 30198826 5/2012
CN 302058056 9/2012
CN 302225957 S 12/2012

(56) References Cited

FOREIGN PATENT DOCUMENTS

| | | | |
|---|---|---|---|
| CN | 302328863 | S | 2/2013 |
| CN | 202800555 | | 3/2013 |
| CN | 103005839 | | 4/2013 |
| CN | 203194906 | | 9/2013 |
| CN | 203220069 | | 10/2013 |
| CN | 203220073 | | 10/2013 |
| CN | 203252150 | | 10/2013 |
| CN | 302956580 | S | 10/2014 |
| DE | 19858102 | | 6/2000 |
| DE | 202005009026 | | 10/2005 |
| DE | 102006016939 | | 5/2007 |
| DE | 102006005616 | | 8/2007 |
| DE | 102006024874 | | 11/2007 |
| DE | 202008016004 | | 2/2009 |
| EM | 000366984-0001 | | 7/2005 |
| EM | 000638028-0002 | | 12/2006 |
| EM | 001975079-0005 | | 1/2012 |
| EM | 002163675-0002 | | 1/2013 |
| EM | 002163675-0003 | | 1/2013 |
| EM | 002212522-0004 | | 4/2013 |
| EM | 002212522-0012 | | 4/2013 |
| EM | 002424069-0001 | | 3/2014 |
| EP | 0716821 | | 6/1996 |
| EP | 0769920 | | 9/2003 |
| EP | 2810581 | | 12/2014 |
| ES | 1063617 | | 11/2006 |
| IT | 2010PDO000035-0019 | | 10/2010 |
| JP | H08164025 | | 6/1996 |
| JP | 10042957 | | 8/1996 |
| JP | D1314270 | | 10/2007 |
| KR | 20040032038 | | 4/2004 |
| KR | 838174 | | 6/2007 |
| KR | 20-2012-0005449 | | 7/2012 |
| MX | 32553 | | 11/2009 |
| MX | 36113 | | 4/2011 |
| MX | 36650 | | 4/2011 |
| RU | 55985 | | 1/2005 |
| RU | 79787 | | 10/2011 |
| RU | 80086 | | 11/2011 |
| RU | 81915 | | 6/2012 |
| WO | WO1995/06420 | | 3/1995 |
| WO | WO1995/10959 | | 4/1995 |
| WO | WO1999/023910 | | 5/1999 |
| WO | WO1999/55514 | | 11/1999 |
| WO | WO1999/65358 | | 12/1999 |
| WO | WO2000/49911 | | 8/2000 |
| WO | WO2001/17392 | | 3/2001 |
| WO | WO2001/29128 | | 4/2001 |
| WO | WO2001/45573 | | 6/2001 |
| WO | WO2001/182741 | | 11/2001 |
| WO | WO2004/043669 | | 5/2004 |
| WO | WO2005/122827 | | 12/2005 |
| WO | WO2008/017996 | | 2/2008 |
| WO | 2009/157955 | | 12/2009 |
| WO | WO2011/070549 | | 6/2011 |
| WO | WO2012/017923 | | 2/2012 |
| WO | WO2012/115035 | | 8/2012 |
| WO | WO2012/176741 | | 12/2012 |
| WO | WO2013/031685 | | 3/2013 |

OTHER PUBLICATIONS

International Search Report and the Written Opinion issued in International Application PCT/US2012/070760 dated Oct. 14, 2013.
International Search Report and the Written Opinion issued in International Application PCT/US2014/072075 dated Sep. 15, 2015.

* cited by examiner

ORAL CARE IMPLEMENT

BACKGROUND

A toothbrush is used to clean the teeth by removing plaque and debris from the tooth surfaces. Toothbrushes have a handle for gripping and a head which is inserted into a user's mouth for tooth and oral surface cleaning. The head typically has bristles formed of nylon and sometimes also cleaning elements formed from elastomeric materials to perform the cleaning function. Furthermore, some toothbrushes have been developed that include a tongue or soft tissue cleanser formed of an elastomeric material on the opposite surface of the head relative to the bristles. Conventional toothbrushes may also include a handle and/or thumb grip that is formed with elastomeric materials for ease and comfort during handling and use. There are countless different toothbrushes that are available to consumers for purchase, and thus a great deal of innovation goes into the design of each toothbrush in order to capture the attention of consumers while also attempting to improve the effectiveness of the toothbrush at performing its cleaning function. Thus, a need exists for a toothbrush or other oral care implement that has aesthetically pleasing and attractive features while still being effective at removing bacteria from a user's teeth and other oral surfaces.

BRIEF SUMMARY

Exemplary embodiments according to the present disclosure are directed to an oral care implement that may include a handle and a head coupled thereto. The head has a front surface and an opposite rear surface. The oral care implement includes an elastomeric soft tissue cleanser comprising a plurality of protuberances extending from the rear surface of the head and a plurality of tooth cleaning elements extending from the front surface of the head. The free ends of the protuberances collectively define a convex longitudinal profile and comprise at least one convex transverse top profile. The free ends of the tooth cleaning elements collectively define a concave longitudinal side profile and comprise at least one concave transverse top profile.

In one aspect, the invention can be an oral care implement comprising a handle; a head coupled to the handle, the head comprising a front surface and a rear surface opposite the front surface, the head extending from a proximal end to a distal end along a longitudinal axis; an elastomeric soft tissue cleanser comprising a plurality of protuberances extending from the rear surface of the head and terminating in free ends, the free ends of the protuberances collectively defining a convex longitudinal side profile and comprising at least one convex transverse top profile; and a plurality of tooth cleaning elements extending from the front surface of the head and terminating in free ends, the free ends of the tooth cleaning elements collectively defining a concave longitudinal side profile and comprising at least one concave transverse top profile.

In another aspect, the invention can be an oral care implement comprising a handle; a head coupled to the handle, the head comprising a front surface, a rear surface opposite the front surface, a longitudinal axis extending from a proximal end to a distal end, and a central transverse plane, the longitudinal axis intersecting and orthogonal to the central transverse plane; an elastomeric soft tissue cleanser comprising a plurality of protuberances extending from the rear surface of the head and terminating in free ends, the free ends of the protuberances collectively forming a longitudinal side profile having a height, measured from the rear surface of the head, that decreases with longitudinal distance from the central transverse plane, and the free ends of the protuberances comprising at least one transverse top profile having a height, measured from the rear surface of the head, that decreases with transverse distance from the longitudinal axis; and a plurality of tooth cleaning elements extending from the front surface of the head and terminating in free ends, the free ends of the tooth cleaning elements collectively defining a longitudinal side profile having a height, measured from the front surface of the head, that increases with longitudinal distance from the central transverse plane, and the free ends of the tooth cleaning elements comprising at least one transverse top profile having a height, measured from the front surface of the head, that increases with transverse distance from the longitudinal axis.

In yet another aspect, the invention can be an oral care implement comprising a handle; a head coupled to the handle, the head comprising a front surface and a rear surface opposite the front surface, the head extending from a proximal end of the head to a distal end of the head along a longitudinal axis; an elastomeric soft tissue cleanser comprising a plurality of protuberances extending from the rear surface of the head and terminating in free ends, each of the protuberances having a height measured from the rear surface of the head to its free end, and wherein the free ends of the protuberances comprise at least one convex transverse top profile formed by a variation in the heights of the protuberances along a first transverse plane that intersects and is substantially orthogonal to the longitudinal axis; and a plurality of tooth cleaning elements extending from the front surface of the head and terminating in free ends, each of the tooth cleaning elements having a height measured from the front surface of the head to its free end, the free ends of the tooth cleaning elements comprising at least one concave transverse top profile formed by a variation in the heights of the tooth cleaning elements along a second transverse plane that intersects and is substantially orthogonal to the longitudinal axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
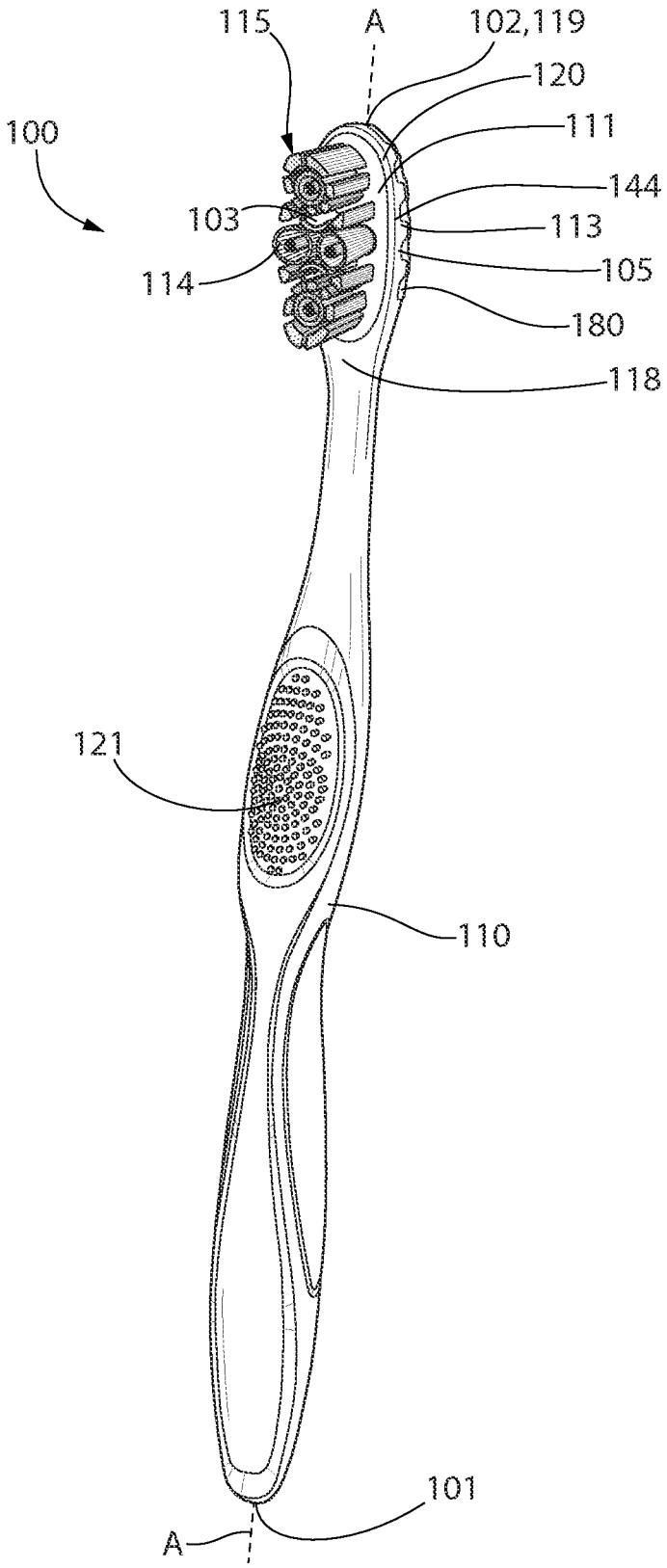
FIG. 1 is front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
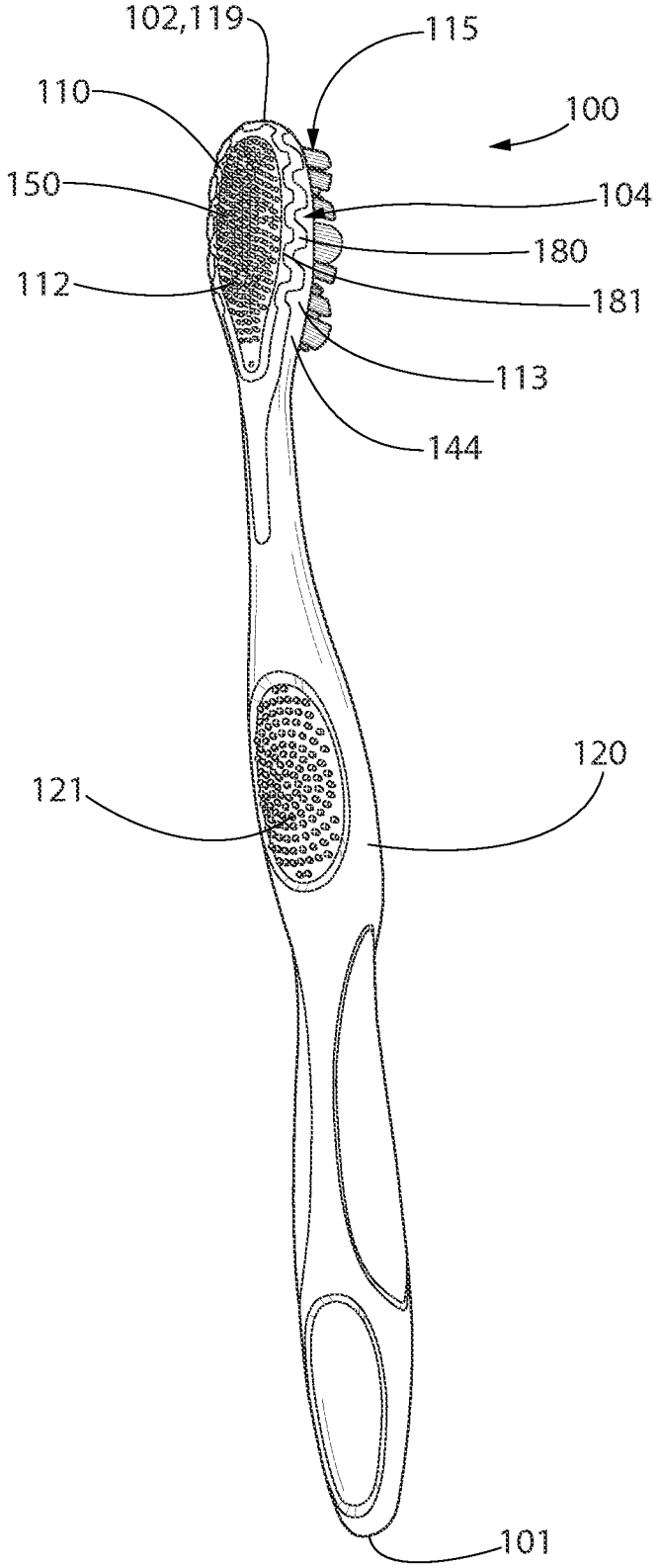
FIG. 2 is a rear perspective view of the oral care implement of FIG. 1.
Figure 3:
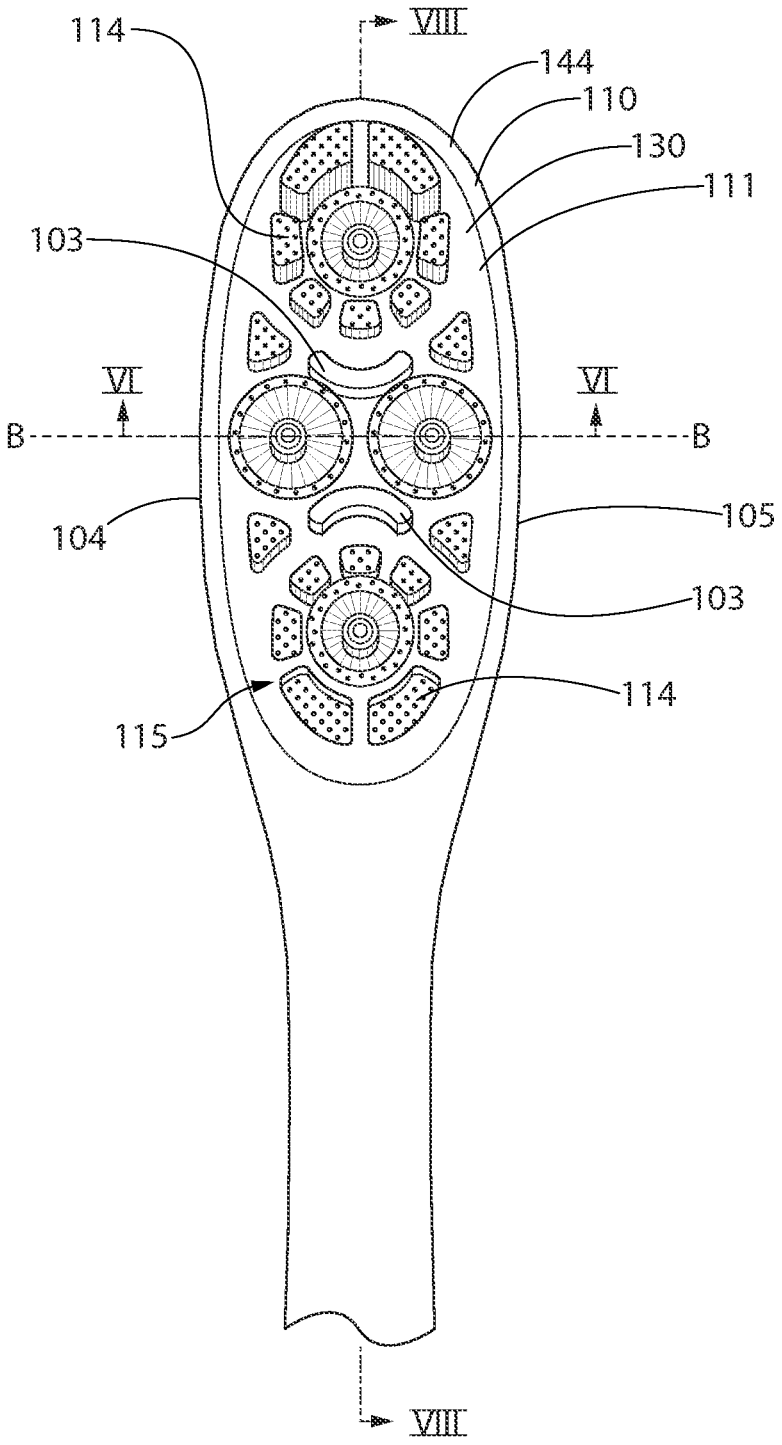
FIG. 3 is a close-up front view of a head of the oral care implement of FIG. 1.
Figure 4:
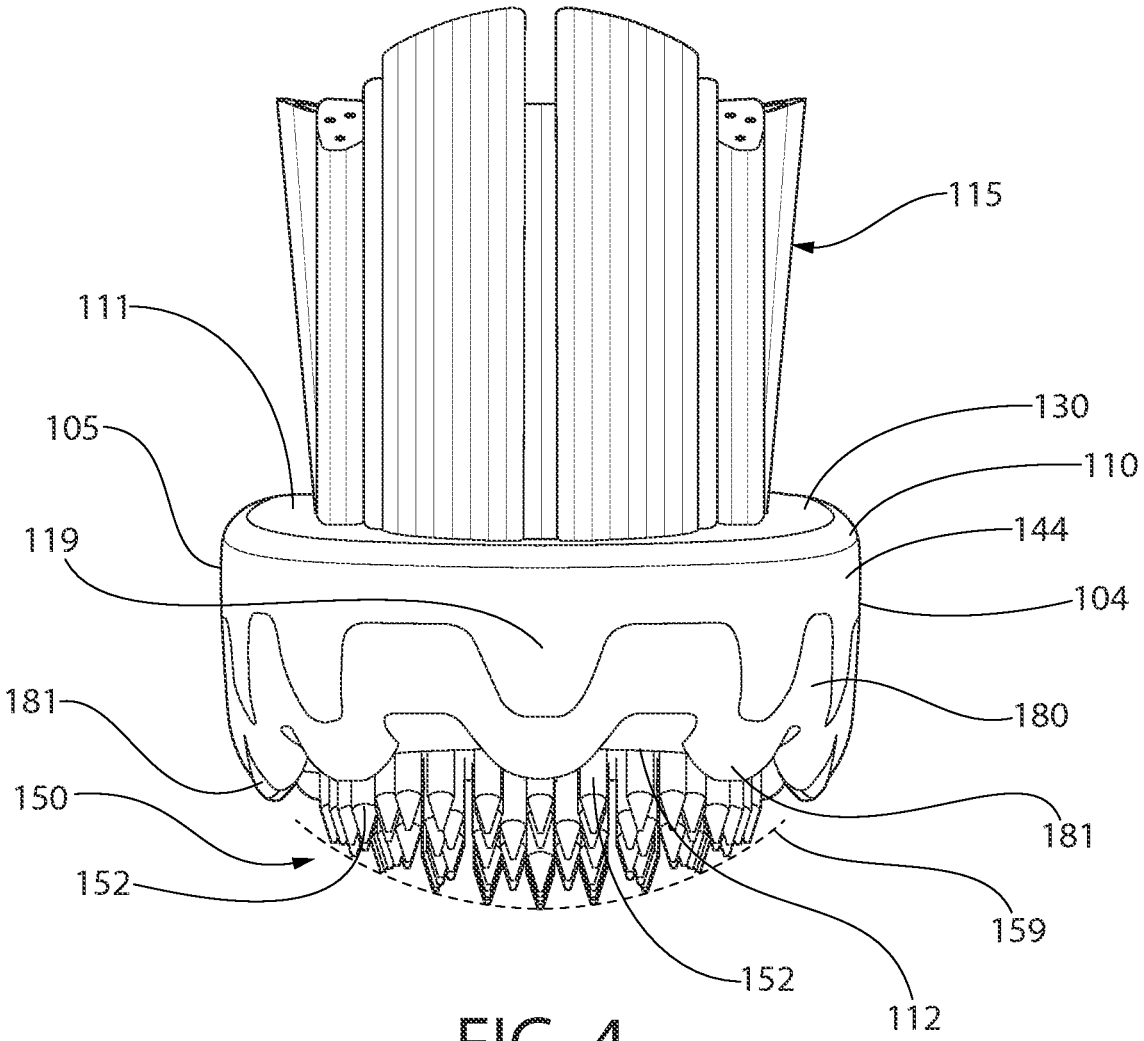
FIG. 4 is a top view of the head of the oral care implement of FIG. 1.

Referring first to FIGS. 1 and 2 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100, which generally comprises a head 110 and a handle 120, extends from a proximal end 101 to a distal end 102 along a longitudinal axis A-A. The head 110 extends from a proximal end 118 to a distal end 119 along a longitudinal axis that is coextensive with the longitudinal axis A-A of the oral care implement 100. Furthermore, in the exemplified embodiment the distal end 102 of the oral care implement 100 is the same as the distal end 119 of the head 110.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a hard or rigid plastic material, such as for example without limitation polymers and copolymers of ethylene, propylene, butadiene, vinyl compounds, and polyesters such as polyethylene terephthalate. The handle 120 also includes a grip 121 that is formed of a resilient/elastomeric material. In the exemplified embodiment the grip 121 is molded over a portion of the handle 120 that is typically gripped by a user's thumb and forefinger during use. Furthermore, it should be appreciated that additional regions of the handle 120 can be overmolded with the resilient/elastomeric material to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used to form the handle 120, including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment the front surface 111 is a continuous and planar surface of the head 110. Furthermore, the head 110 comprises a peripheral surface 113 extending between the rear surface 112 and the front surface 111. The peripheral surface 113 of the head 110 includes a first lateral side 104 and a second lateral side 105. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The invention is not to be limited by the structure, pattern, orientation, and material of the tooth cleaning elements 115 in all embodiments. Furthermore, where it does not conflict with the other disclosure provided herein or the claims, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning element field in some embodiments. Furthermore, where bristles are used for one or more of the tooth cleaning elements 115, such bristles can be tapered, end-rounded, spiral, or the like.

In embodiments that use elastomeric materials to form one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 6:
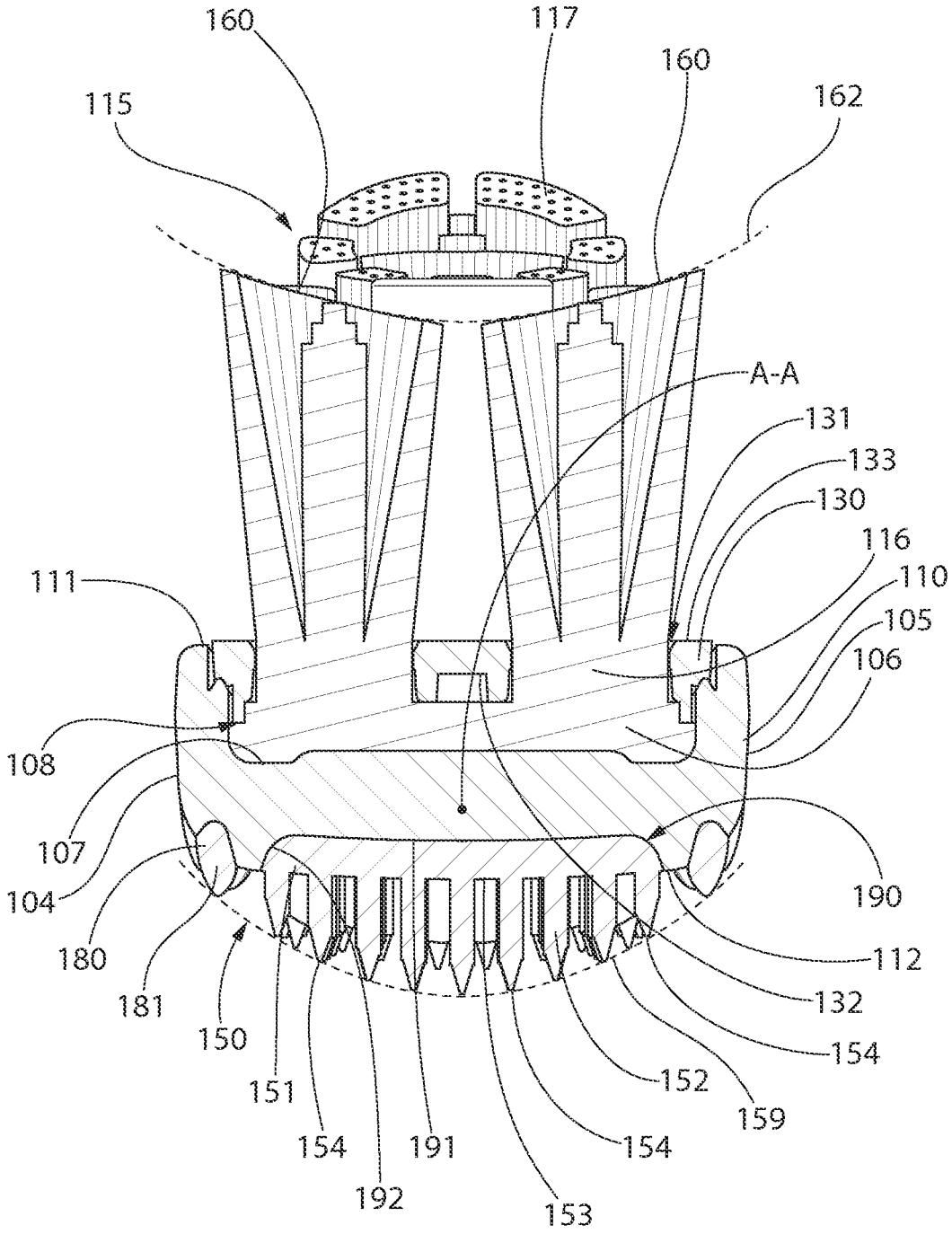
FIG. 6 is a cross-section taken along line VI-VI of FIG. 3.
Figure 7:
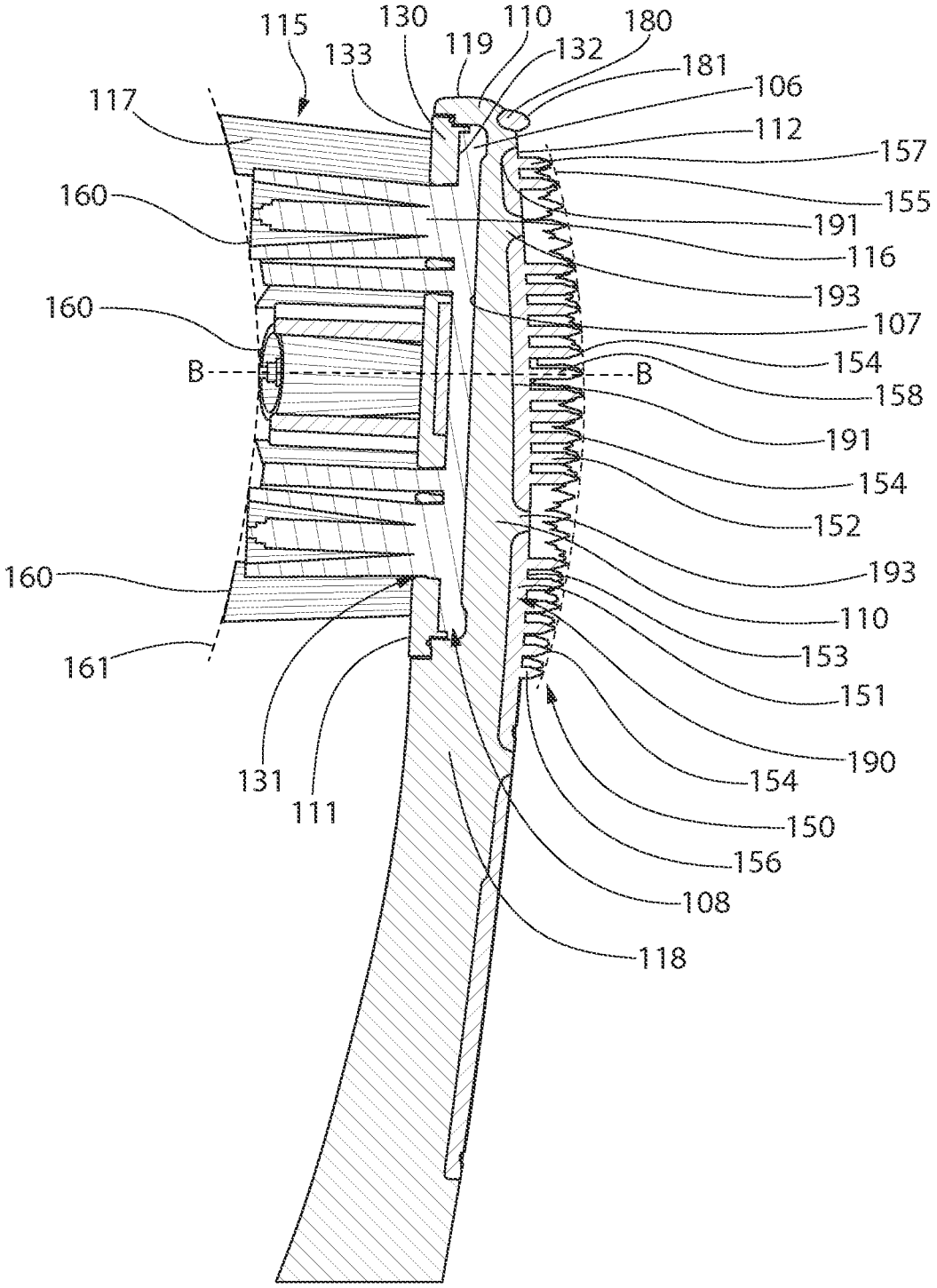
FIG. 7 is a cross-section taken along line VII-VII of FIG. 3.

The tooth cleaning elements 115 may be coupled to the head 110 in any manner known in the art, including staples, in-mold tufting (IMT), anchor-free tufting (AFT), or a modified AFT known as AMR. Referring briefly to FIGS. 6 and 7, one manner in which the tooth cleaning elements 115 are secured to the head 110 via AFT will be described. Specifically, in the exemplified embodiment the tooth cleaning elements 115 are formed as a cleaning element assembly on a head plate 130 such that one or more of the tooth cleaning elements 115 are mounted onto the head plate 130 and then the head plate 130 is coupled to the head 110. In such an embodiment, the head plate 130 is a separate and distinct component from the head 110 of the oral care implement 100. However, the head plate 130 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 130 and the head 110 are separately formed components that are secured together during manufacture of the oral care implement 100.

In certain embodiments, the head plate 130 may comprise an upper surface 133 and a lower surface 132. The upper surface 133 of the head plate 130 forms a portion of the front surface 111 of the head 110 when the head plate 130 is coupled to the head 110 as discussed herein. The head plate 130 comprises a plurality of holes 131 formed therethrough from the upper surface 133 to the lower surface 132, and the tooth cleaning elements 115 may be mounted to the head plate 130 within the holes 131. Specifically, in AFT a plate or membrane (i.e., the head plate 130) is created separately from the head 110. The tooth cleaning elements 115 (such as bristles, elastomeric elements, and combinations thereof) are positioned into the head plate 130 so as to extend through the holes 131 of the head plate 130. Free ends 117 of the tooth cleaning elements 115 on one side of the head plate 130 perform the cleaning function. Anchor portions 116 of the tooth cleaning elements 115 on the other side of the head plate 130 are melted together by heat to be anchored in place. As the tooth cleaning elements 115 are melted together, a melt matte 106 is formed. The melt matte 106 is a thin layer of plastic that is formed by melting the anchor portions 116 of the tooth cleaning elements 115 so that the anchor portions 116 of the tooth cleaning elements transition into a liquid, at which point the liquid of the anchor portions 116 of the tooth cleaning elements combine together into a single layer of liquid plastic that at least partially covers the lower surface 132 of the head plate 130. After the heat is no longer applied, the melted anchor portions 116 of the bristles solidify/harden to form the melt matte 106 or thin layer of plastic.

After the tooth cleaning elements 115 are secured to the head plate 130, the head plate 130 is secured to the head 110 such as by ultrasonic welding or mechanical techniques (i.e., snap-fit, interference fit, slot-and-tab, or the like) so that the upper surface 133 of the head plate 130 forms at least a portion of the front surface 111 of the head 110. When the head plate 130 is coupled to the head 110, the melt matte 106 is located between the lower surface 132 of the head plate 130 and a floor 107 of a basin 108 of the head 110 in which the head plate 130 is disposed. The melt matte 106, which is coupled directly to and in fact forms a part of the tooth cleaning elements 115, prevents the tooth cleaning elements 115 from being pulled through the holes 131 in the head plate 130 to ensure that the tooth cleaning elements 115 remain attached to the head plate 130 during use of the oral care implement 100.

As noted above, in another embodiment the tooth cleaning elements may be connected to the head 110 using a technique known in the art as AMR. In this technique, the handle is formed integrally with the head plate as a one-piece structure. After the handle and the head plate are formed, the bristles are inserted into holes in the head plate so that the free/cleaning ends of the bristles extend from the front surface of the head plate and the bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleanser is injection molded onto the rear surface of the head plate, thereby trapping the melt matte between the tissue cleanser and the rear surface of the head plate. In other embodiments, other structures may be coupled to the rear surface of the head plate to trap the melt matte between the rear surface of the head plate and such structure without the structure necessarily being a tissue cleanser (the structure can just be a plastic material that is used to form a smooth rear surface of the head, or the like).

Of course, techniques other than AFT and AMR can be used for mounting the tooth cleaning elements 115 to the head 110, such as widely known and used stapling techniques or the like. In such embodiments the head plate 130 may be omitted and the tooth cleaning elements 115 may be coupled directly to the head 110. Furthermore, in a further modified version of the AFT and AMR processes discussed above, the head plate 130 may be formed by positioning the tooth cleaning elements 115 within a mold, and then molding the head plate 130 around the tooth cleaning elements 115 via an injection molding process.

Referring now to FIGS. 1-5 concurrently, in the exemplified embodiment the plurality of tooth cleaning elements 115 includes a plurality of separate tufts of bristles 114 and a plurality of elastomeric tooth cleaning elements 103. Although illustrated herein as having a specific arrangement and shape, in certain embodiments the arrangement of the tufts of bristles 114 and elastomeric tooth cleaning elements 103 as well as the shapes thereof can be modified from that which is depicted in the figures within the bounds of the disclosure set forth herein. Specifically, the pattern, orientation, and positioning of the tufts of bristles 114 and the elastomeric tooth cleaning elements 103 may be modified from that which is depicted in the figures so long as the various concave and convex profiles formed by the tooth cleaning elements as described herein below remain.

The head 110 of the oral care implement 100 comprises a base 144 that is formed of a hard plastic material, such as any of the materials noted above for forming the handle 120 (including polypropylene and the like). Furthermore, the head 110 comprises an elastomeric soft tissue cleanser 150 and a bumper 180 that are coupled to the base 144. Each of the elastomeric soft tissue cleanser 150 and the bumper 180 are formed of a resilient and flexible elastomeric material, such as a thermoplastic elastomer. The elastomeric soft tissue cleanser 150 and the bumper 180 serve to clean the user's tongue and soft tissue surfaces and to protect the user's gums during toothbrushing. Specifically, the bumper 180 is positioned on the peripheral surface 113 of the head 110 and thus reduces the impact of the hard plastic of the base 144 against the user's gums during use of the toothbrush. The bumper 180 also includes raised features 181 that protrude beyond the rear surface 112 of the head 110 and can also be used for cleaning/scraping a user's tongue. The elastomeric soft tissue cleanser 150 is positioned on the rear surface 112 (and in fact forms a part of the rear surface) of the head 110 and can be used to clean and scrub a user's tongue and other soft tissue surfaces. The combination of the bumper and the elastomeric soft tissue cleanser 150, 180 also results in a highly desirable aesthetic appearance for the oral care implement 100.

Referring briefly to FIGS. 4-7, the elastomeric soft tissue cleanser 150 generally comprises a pad 151 and a plurality of protuberances 152 that extend from the pad 151. In the exemplified embodiment, each of the plurality of protuberances 152 is in the form of a nub. As used herein a "nub" generally refers to a column-like protrusion (without limitation to the cross-sectional shape of the protrusion) which is upstanding from a base surface. In the exemplified embodiment, the protuberances 152 are nubs comprising a cylindrical body portion and a tapered tip portion. In a general sense, the protuberances 152 in the preferred construction have a height that is greater than the width at the base of the protuberance 152 (as measured in the longest direction). Nevertheless, protuberances or nubs could include projections wherein the widths and heights are roughly the same or wherein the heights are somewhat smaller than the base widths. Moreover, in some circumstances (e.g., where the protuberances taper to a tip or include a base portion that narrows to a smaller projection), the base width can be substantially larger than the height. Furthermore, in the exemplified embodiment the plurality of protuberances 152 have varying heights such that some of the protuberances 152 are taller than other of the protuberances 152. The varying heights of the protuberances 152 results in the protuberances 152 forming convex profiles depending on the viewing angle as described in more detail below.

The base 144 of the head 110 comprises a basin 190 formed therein. The basin 190 is defined by a floor 191 that is recessed relative to the rear surface 112 of the head 110 and a sidewall 192 that extends from the floor 191 to the rear surface 112 of the head 110. The elastomeric soft tissue cleanser 150 is positioned within the basin 190. More specifically, the pad 151 of the elastomeric soft tissue cleanser 150 is disposed within the basin 190 so that an exposed surface 153 of the pad 151 is flush or substantially flush with the portion of the rear surface 112 of the head 110 that is formed by the base 144 (substantially flush can be the exposed surface 153 of the pad 151 either extending beyond or being recessed relative to the rear surface 112 of the base 144 of the head 110 by between approximately 0.1 mm and 1.0 mm). The exposed surface 153 of the pad 151 thus forms a part of the rear surface 112 of the head 110. Furthermore, the plurality of protuberances 152 extend from the rear surface 112 of the head 110 for contact with a user's soft tissue surfaces. The elastomeric soft tissue cleanser 150 may be coupled to the head via an injection molding process (i.e., by injection molding an elastomeric material directly into the basin 190 while the head 110 is positioned within a mold). In certain embodiments the head 110 may include one or more peg members 193 that extend upwardly from the floor 191 of the basin 190 to assist in retaining the elastomeric soft tissue cleanser 150 within the basin 190.

Figure 8:
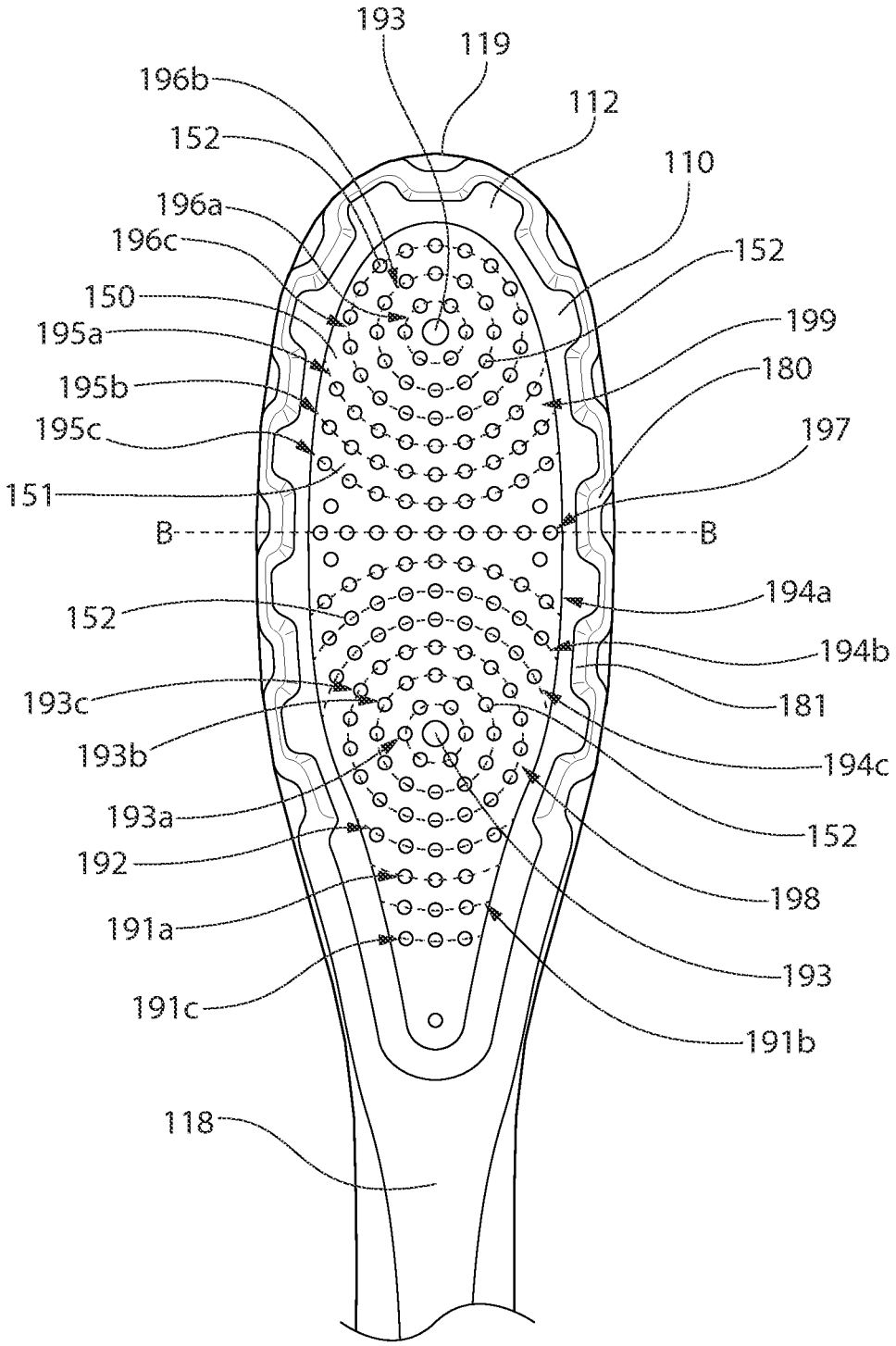
FIG. 8 is a rear view of the head of the oral care implement of FIG. 1.

Referring briefly to FIG. 8, in the exemplified embodiment the protuberances 152 of the elastomeric soft tissue cleanser 150 are arranged in a particular pattern on the rear surface 112 of the head 110. Specifically, the protuberances 152 are arranged to form a first set of concentric rings 199 and a second set of concentric rings 198. The first set of concentric rings 199 are positioned on the upper half of the rear surface 112 of the head 110 and the second set of concentric rings 198 are positioned on the lower half of the rear surface 112 of the head 110. The upper and lower halves of the rear surface 112 of the head 110 (and the first and second sets of concentric rings 199, 198) are separated by a single transverse row 197 of the protuberances 152 (although more than one transverse row may be included in alternative embodiments). The first set of concentric rings 199 comprises a first ring 196*a* that surrounds one of the peg members 193, a second ring 196*b* that surrounds the first ring 196*a*, and a third ring 196*c* that surrounds the second ring 196*b*. The second set of concentric rings 198 comprises a first ring 193*a* that surrounds one of the peg members 193, a second ring 193*b* that surrounds the first ring 193*a*, and a third ring 193*c* that surrounds the second ring 193*b*.

Furthermore, the protuberances 154 form three arcuate rows 195*a-c* positioned between the first set of concentric rings 199 and the transverse row 197. Each of three arcuate rows 195*a-c* has a concave surface facing the first set of concentric rings 199 and a convex surface facing the transverse row 197. The protuberances 154 also form three arcuate rows 194*a-c* positioned between the transverse row 197 and the second set of concentric rings 199. Each of the three arcuate rows 194*a-c* has a concave surface facing the second set of concentric rings 198 and a convex surface facing the transverse row 197. Finally, the protuberances 154 form a fourth arcuate row 192 adjacent to the third ring 193*c* and three substantially transverse rows 191*a-c* between the fourth arcuate row 192 and the proximal end 118 of the head 110. Each of the various rings, arcuate rows, and transverse rows described above are formed by a plurality of the protuberances 152 that are arranged in a spaced-apart manner. Each of the various rings, arcuate rows, and transverse rows is delineated with a dotted line for ease of understanding of the description herein above.

The elastomeric soft tissue cleanser 150 is symmetric about a plane that intersects and extends along the transverse row 197 from the third ring 196*c* of the first set of concentric rings 199 to the third ring 193*c* of the second set of concentric rings 198. The elastomeric soft tissue cleanser 150 in its entirety is asymmetric about the plane that intersects and extends along the transverse row 197 due to the additional rows 192, 191*a-c* located between the third ring 193*c* of the second set of concentric rings 198 and the proximal end 118 of the head 110.

Figure 5:
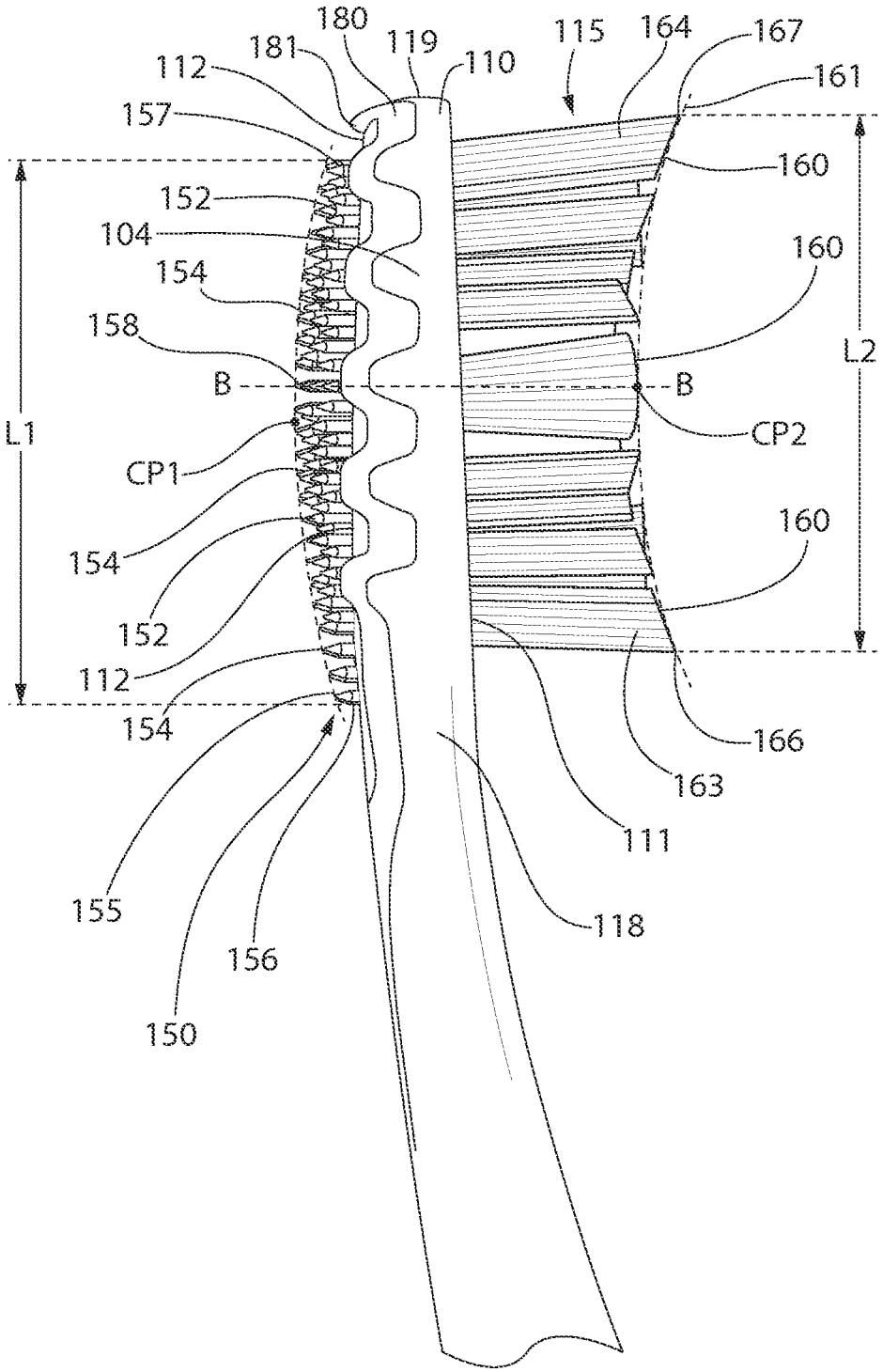
FIG. 5 is a side view of the head of the oral care implement of FIG. 1.

Referring now to FIGS. 5-7, the oral care implement 100 will be further described. As noted above, the elastomeric soft tissue cleanser 150 comprises the plurality of protuberances 152 that extend from the rear surface 112 of the head 110. Each of the protuberances 152 of the elastomeric soft tissue cleanser 150 terminates in a free end 154. The free ends 154 of the protuberances 152 collectively define a convex longitudinal side profile 155. Thus, when viewed from the side of the head 110 as depicted in FIG. 5, the convex longitudinal side profile 155 is formed by the free ends 154 of the protuberances 152. The convex longitudinal side profile 155 is delineated with a dashed line for ease of understanding.

The convex longitudinal side profile 155 defined by the free ends 154 of the protuberances 152 is achieved due to a variation in the heights of the protuberances 152 as measured from the rear surface 112 of the head 110 to the free ends 154 of the protuberances 152. More specifically, each of the protuberances 152 has a height measured from the rear surface 112 of the head 110 to its free end 154. The relative heights of the protuberances 152 increases in a direction of the longitudinal axis A-A from a proximal-most one 156 of the protuberances 152 to a tallest one 158 of the protuberances 152 and then decreases in the direction of the longitudinal axis A-A from the tallest one 158 of the protuberances 152 to a distal-most one 157 of the protuberances 152. The protuberances 152 can be broken down into longitudinal columns (each column being formed by substantially aligned protuberances that extend from the proximal end 118 of the head 110 to the distal end 119 of the head 110 along the longitudinal axis A-A or along an axis that is parallel to the longitudinal axis A-A). The protuberances 152 in each longitudinal column increase in height from the protuberance within that column that is located nearest to the proximal end 118 of the head 110 to a central transverse plane B-B (or some other transverse plane located at the peak height of the protuberances 152). The protuberances 152 in each longitudinal column also increase in height from the protuberance within that column that is located nearest to the distal end 119 of the head 110 to the central transverse plane B-B (or some other transverse plane located at the peak height of the protuberances 152).

In the exemplified embodiment, the head 110 comprises the central transverse plane B-B, which is a plane that extends orthogonally to and intersects the longitudinal axis A-A and which is located approximately centrally on the head 110 between the proximal and distal ends 118, 119 of the head 110. In certain embodiments, the tallest one (or ones) 158 of the protuberances 154 is positioned so as to be intersected by the central transverse plane B-B. In such embodiments the heights of the protuberances 152 decrease with longitudinal distance from the central transverse plane B-B towards the proximal and distal ends 118, 119 of the head 110. The decrease in height may be gradual and continuous in some embodiments, or stepped in other embodiments.

In addition to the convex longitudinal side profile 155, the free ends 154 of the protuberances 152 also comprise at least one convex transverse top profile 159. Thus, when viewed along at least one transverse plane that intersects and is substantially orthogonal to the longitudinal axis A-A (such as the view provided in FIG. 6, for example), the free ends 154 of the protuberances 152 form a convex profile. The convex transverse top profile 159 is delineated in dotted lines in FIGS. 4 and 6 for ease of understanding. The term top profile is intended to mean the profile that is seen by a viewer who is viewing the toothbrush from the distal end 119 of the head 110 or from a transverse plane that is substantially orthogonal to and intersects the longitudinal axis A-A and that is taken through the head 110 from the first lateral side 104 to the second lateral side 105.

FIG. 6 illustrates a cross-sectional view of the head taken along one such transverse plane. As can be seen, the convex transverse top profile 159 of the free ends 154 of the protuberances 152 is formed along the transverse plane due to a variation in the heights of the protuberances 152 along the transverse plane. Thus, in the exemplified embodiment the heights of the protuberances 154 decrease along the transverse plane with distance from the longitudinal axis A-A towards the first and second lateral sides 104, 105 of the head 110. Stated another way, along the transverse plane the protuberances 152 nearest to the first and second lateral sides 104, 105 of the head 110 are shortest, and the heights of the protuberances 154 gradually increase from the protuberances 152 nearest to the first and second lateral sides 104, 105 of the head 110 to the protuberance 152 that is aligned with the longitudinal axis A-A.

Thus, the free ends 154 of the protuberances 152 collectively define the convex longitudinal side profile 155 (see FIG. 5) and the free ends 154 of the protuberances 152 comprise at least one convex top profile 159 (see FIG. 6). Although the convex top profile 159 is only depicted along one transverse plane that intersects and is substantially orthogonal to the longitudinal axis A-A, the free ends 154 of the protuberances 152 may comprise multiple convex top profiles taken at multiple different transverse planes that intersect and are substantially orthogonal to the longitudinal axis A-A.

Still referring to FIGS. 5-7, in addition to the free ends 154 of the protuberances 152 forming the convex longitudinal side profile 155 and comprising the at least one convex transverse top profile 159, the tooth cleaning elements 115 form concave profiles. More specifically, the plurality of tooth cleaning elements 115 terminate in free ends 160. The free ends 160 of the tooth cleaning elements 115 collectively define a concave longitudinal side profile 161 (delineated in dashed lines). In the exemplified embodiment, the concave longitudinal side profile 161 is formed due to a variation in height of the tooth cleaning elements 115 as measured from the front surface 111 of the head 110 to the free ends 160 of the tooth cleaning elements 115. The height of the tooth cleaning elements 115 (and also of the concave longitudinal side profile 161) gradually and continuously increases from the central transverse plane B-B to proximal-most 163 and distal-most 164 ones of the tooth cleaning elements 115 (i.e., towards the proximal and distal ends 118, 119 of the head 110). Although described herein as forming a convex longitudinal side profile, it should be understood that in certain embodiments although the terminal ends 160 of the tooth cleaning elements 115 generally form a concave shape, there may be some tooth cleaning elements that extend beyond or above the general concave shaped-profile. Thus, every single tooth cleaning element 115 need not follow the contours of the concave profile. Rather, some of the tooth cleaning elements 115 may extend beyond the concave profile while the terminal ends 160 of the tooth cleaning elements 115 still form a readily visible concave longitudinal side profile 161.

In addition, the free ends 160 of the tooth cleaning elements 115 comprise at least one concave transverse top profile 162 (delineated in dashed lines for reference). Thus, when viewed along at least one transverse plane that intersects and is substantially orthogonal to the longitudinal axis A-A (such as the view provided in FIG. 6, for example), the free ends 160 of the tooth cleaning elements 115 form a concave profile. In the exemplified embodiment the at least one transverse plane is the central transverse plane B-B. However, there may be other transverse planes at which the free ends 160 of the tooth cleaning elements 115 form a concave transverse top profile. As can be seen in FIG. 6, the concave transverse top profile 162 is formed due to the heights of the tooth cleaning elements 115 increasing with distance from the longitudinal axis A-A towards the lateral sides 104, 105 of the head 110 along the transverse plane. Although described herein as forming the concave transverse top profile 162, it should be understood that in certain embodiments although the terminal ends 160 of the tooth cleaning elements 115 generally form the concave shape of the concave transverse top profile 162, there may be some tooth cleaning elements that extend beyond or above the general concave shaped profile. Thus, every single tooth cleaning element 115 need not follow the contours of the concave transverse top profile 162. Rather, some of the tooth cleaning elements 115 may extend beyond the concave transverse top profile 162 while the terminal ends 160 of the tooth cleaning elements 115 still form a readily visible concave transverse top profile 161.

As seen in FIG. 6, in the exemplified embodiment the free ends 160 of the tooth cleaning elements 115 comprise the concave transverse top profile 161 and the free ends 154 of the protuberances 152 comprise the convex transverse top profile 159 along the same transverse plane (i.e., the central transverse plane B-B). Thus, in the exemplified embodiment when the toothbrush is viewed at the location of the central transverse plane B-B, the free ends 160 of the tooth cleaning elements 115 form the concave transverse top profile 161 and the free ends 154 of the protuberances 152 form the convex transverse top profile 159.

However, in certain embodiments the convex transverse top profile 159 of the protuberances 152 may be formed along a first transverse plane that intersects and is substantially orthogonal to the longitudinal axis A-A and the concave transverse top profile 162 of the tooth cleaning elements 115 may be formed along a second transverse plane that intersects and is substantially orthogonal to the longitudinal axis A-A. In some embodiments the first and second transverse planes may be the same as noted herein above (i.e., the central transverse plane B-B). In other embodiments the first and second transverse planes may be different. In one particular embodiment, the first transverse plane may be positioned closer to the distal end 119 of the head 110 than the second transverse plane 118. In another particular embodiment the first transverse plane may be positioned closer to the proximal end 118 of the head 110 than the second transverse plane 118. In still other embodiments convex transverse top profiles may be formed by the protuberances 152 along transverse planes located on opposite sides of the transverse plane along which the concave transverse top profile is formed by the tooth cleaning elements 115.

Furthermore, in some embodiments the convex longitudinal side profile 155 formed by the free ends 154 of the protuberances 152 has a maximum height at the central transverse plane B-B and the concave longitudinal side profile 161 formed by the free ends 160 of the tooth cleaning elements 115 has a minimum height at the central transverse plane B-B. However, in the exemplified embodiment, the convex longitudinal side profile 155 formed by the free ends 154 of the protuberances 152 has a maximum height that is offset from a minimum height of the concave longitudinal side profile 161 formed by the free ends 160 of the tooth cleaning elements 115. More specifically, the maximum height of the convex longitudinal side profile 155 (formed by the tallest protuberance 158) is located closer to the distal end 119 of the head 110 than the minimum height of the concave longitudinal side profile 161 (see FIG. 5).

Furthermore, in the exemplified embodiment the longitudinal side profile 155 formed by the free ends 154 of the protuberances 152 has a longitudinal center point CP1 that is longitudinally offset (i.e., spaced apart in the longitudinal direction) from the central transverse plane B-B. More specifically, the longitudinal center point CP1 of the convex longitudinal side profile 155 is located between the central transverse plane B-B and the proximal end 118 of the head 110. Thus, the convex longitudinal side profile 155 formed by the free ends 154 of the protuberances 152 is asymmetric about the central transverse plane B-B. The concave longitudinal side profile 161 formed by the free ends 160 of the tooth cleaning elements 115 has a longitudinal center point CP2 that is located on the central transverse plane B-B. Thus, the concave longitudinal side profile 161 formed by the free ends 160 of the tooth cleaning elements 115 is symmetric about the central transverse plane B-B.

Thus, the tooth cleaning elements 115 collectively form the concave longitudinal side profile 161 and comprise the at least one concave transverse top profile 162 and the protuberances 152 collectively form the convex longitudinal side profile 155 and comprise the at least one convex transverse top profile 159. In certain embodiments, the radius of curvature of the concave longitudinal side profile 161 and the convex longitudinal side profile 155 may be the same to enhance the aesthetic, although this is not required in all embodiments. Furthermore, in certain embodiments the radius of curvature of the at least one concave transverse top profile 162 and the at least one convex transverse top profile 159 may be the same, although this is not required in all embodiments.

In the exemplified embodiment, the elastomeric soft tissue cleanser 150 has a first length L1 measured from the free end 154 of the distal-most one 157 of the protuberances 152 to the free end 154 of the proximal-most one 158 of the protuberances 152. Furthermore, the tooth cleaning elements 115 form a tooth cleaning element field having a second length L2 measured from a distal-most portion 167 of the distal-most one 164 of the tooth cleaning elements 115 to a proximal-most portion 166 of the proximal-most one 163 of the tooth cleaning elements 115. In the exemplified embodiment, the first length L1 is greater than the second length L2. However, the invention is not to be so limited in all embodiments and in certain other embodiments the first and second lengths L1, L2 may be equal, and in still other embodiments the second length L2 may be greater than the first length L1.

Furthermore, in the exemplified embodiment the free end 154 of the distal-most one 157 of the protuberances 152 is longitudinally offset from the distal-most portion 167 of the distal-most one 164 of the tooth cleaning elements 115.

More specifically, the distal-most portion 167 of the distal-most one 164 of the tooth cleaning elements 115 is positioned closer to the distal end 119 of the head 110 than the distal-most one 157 of the protuberances 152. Additionally, the proximal-most portion 166 of the free end 160 of the proximal-most one 163 of the tooth cleaning elements 115 is longitudinally offset from the free end 154 of the proximal-most one 156 of the protuberances 152. Most specifically, the free end 154 of the proximal-most one 156 of the protuberances 152 is positioned closer to the proximal end 118 of the head 110 than the proximal-most portion 166 of the proximal-most one 163 of the tooth cleaning elements 115.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface and a rear surface opposite the front surface, the head extending from a proximal end to a distal end along a longitudinal axis;

an elastomeric soft tissue cleanser comprising a plurality of protuberances extending from the rear surface of the head and terminating in free ends, the free ends of the protuberances collectively defining a convex longitudinal side profile and at least one convex transverse top profile; and a plurality of tooth cleaning elements extending from the front surface of the head and terminating in free ends, the free ends of the tooth cleaning elements collectively defining a concave longitudinal side profile and comprising at least one concave transverse top profile;

wherein each of the plurality of protuberances has a height measured from the rear surface of the head to its free end, wherein the convex longitudinal side profile defined by the free ends of the protuberances is formed due to a variation in the heights of the protuberances in a direction of the longitudinal axis; and wherein the convex transverse top profile of the free ends of the protuberances is formed due to a variation in the heights of the protuberances along at least one transverse plane that intersects and is substantially orthogonal to the longitudinal axis.

2. The oral care implement according to claim 1 wherein the head comprises a first lateral side and a second lateral side, and wherein the heights of the protuberances decrease with distance from the longitudinal axis towards the first and second lateral sides of the head.

3. The oral care implement according to claim 1 further comprising:

the head comprising a central transverse plane, the longitudinal axis intersecting and orthogonal to the central transverse plane; and wherein the heights of the protuberances decrease with longitudinal distance from the central transverse plane towards the proximal and distal ends of the head.

4. The oral care implement according to claim 3 wherein the concave longitudinal side profile formed by the free ends of the tooth cleaning elements has a height measured from the front surface of the head to the free ends of the tooth cleaning elements that increases with longitudinal distance from the central transverse plane towards the proximal and distal ends of the head.

5. The oral care implement according to claim 3 wherein the convex longitudinal side profile formed by the free ends of the protuberances has a maximum height at the central transverse plane and the concave longitudinal side profile formed by the free ends of the tooth cleaning elements has a minimum height at the central transverse plane.

6. The oral care implement according to claim 3 wherein the convex longitudinal side profile formed by the free ends of the protuberances has a maximum height that is offset from a minimum height of the concave longitudinal side profile formed by the free ends of the tooth cleaning elements.

7. The oral care implement according to claim 3 wherein the convex longitudinal side profile defined by the free ends of the protuberances has a longitudinal center point that is longitudinally offset from the central transverse plane, and wherein the longitudinal center point of the convex longitudinal side profile is located between the central transverse plane and the proximal end of the head.

8. The oral care implement according to claim 3 wherein the concave longitudinal side profile formed by the free ends of the tooth cleaning elements has a longitudinal center point that is located on the central transverse plane.

9. The oral care implement according to claim 3 wherein the concave longitudinal side profile formed by the free ends of the tooth cleaning elements is symmetric about the central transverse plane and the convex longitudinal side profile formed by the free ends of the protuberances is asymmetric about the central transverse plane.

10. The oral care implement according to claim 1 wherein the convex longitudinal side profile defined by the free ends of the protuberances extends from a distal-most one of the protuberances to a proximal-most one of the protuberances.

11. The oral care implement according to claim 1 wherein the concave longitudinal side profile defined by the free ends of the tooth cleaning elements extends from a distal-most one of the tooth cleaning elements to a proximal-most one of the tooth cleaning elements.

12. The oral care implement according to claim 1 wherein the protuberances are nubs comprising a cylindrical body portion and a tapered tip portion.

13. The oral care implement according to claim 1 wherein the elastomeric soft tissue cleanser has a first length measured from the free end of a distal-most one of the protuberances to the free end of a proximal-most one of the protuberances; wherein the tooth cleaning elements form a tooth cleaning element field having a second length measured from a distal-most portion of the free end of a distal-most one of the tooth cleaning elements to a proximal-most portion of the free end of a proximal-most one of the tooth cleaning elements; and wherein the first length is greater than the second length, wherein the distal-most portion of the free end of the distal-most one of the protuberances is longitudinally offset from the free end of the distal-most one of the tooth cleaning elements, and the proximal-most portion of the free end of the proximal-most one of the protuberances is longitudinally offset from the free end of the proximal-most one of the tooth cleaning elements.

14. The oral care implement according to claim 1 wherein the front surface of the head is a planar surface.

15. An oral care implement comprising:

a handle;

a head coupled to the handle, the head comprising a front surface, a rear surface opposite the front surface, a longitudinal axis extending from a proximal end to a distal end, and a central transverse plane, the longitudinal axis intersecting and orthogonal to the central transverse plane;

an elastomeric soft tissue cleanser comprising a plurality of protuberances extending from the rear surface of the head and terminating in free ends, the free ends of the protuberances collectively forming a longitudinal side profile having a height, measured from the rear surface of the head, that decreases with longitudinal distance from the central transverse plane, and the free ends of the protuberances comprising at least one transverse top profile having a height, measured from the rear surface of the head, that decreases with transverse distance from the longitudinal axis; and a plurality of tooth cleaning elements extending from the front surface of the head and terminating in free ends, the free ends of the tooth cleaning elements collectively defining a longitudinal side profile having a height, measured from the front surface of the head, that increases with longitudinal distance from the central transverse plane, and the free ends of the tooth cleaning elements comprising at least one transverse top profile having a height, measured from the front surface of the head, that increases with transverse distance from the longitudinal axis.

16. The oral care implement according to claim 15 wherein the height of the longitudinal side profile of the elastomeric soft tissue cleanser continuously decreases with distance from the central transverse plane and from the longitudinal axis.

17. The oral care implement according to claim 15 wherein at least one of the longitudinal side profile of the tooth cleaning elements and the longitudinal side profile of the elastomeric soft tissue cleanser is symmetric about the central transverse plane.

18. The oral care implement according to claim 15 wherein the longitudinal side profile formed by the free ends of the protuberances has a maximum height at the central transverse plane and the longitudinal side profile formed by the free ends of the tooth cleaning elements has a minimum height at the central transverse plane.

19. An oral care implement comprising:

a handle;

a head coupled to the handle, the head comprising a front surface and a rear surface opposite the front surface, the head extending from a proximal end of the head to a distal end of the head along a longitudinal axis;

an elastomeric soft tissue cleanser comprising a plurality of protuberances extending from the rear surface of the head and terminating in free ends, each of the protuberances having a height measured from the rear surface of the head to its free end, and wherein the free ends of the protuberances comprise at least one convex transverse top profile formed by a variation in the heights of the protuberances along a first transverse plane that intersects and is substantially orthogonal to the longitudinal axis; and a plurality of tooth cleaning elements extending from the front surface of the head and terminating in free ends, each of the tooth cleaning elements having a height measured from the front surface of the head to its free end, the free ends of the tooth cleaning elements comprising at least one concave transverse top profile formed by a variation in the heights of the tooth cleaning elements along a second transverse plane that intersects and is substantially orthogonal to the longitudinal axis.

20. The oral care implement according to claim 19 wherein the free ends of the protuberances comprise a convex longitudinal top profile having a maximum height at a central transverse plane, the longitudinal axis intersecting and orthogonal to the central transverse plane, and wherein the free ends of the tooth cleaning elements comprise a concave longitudinal top profile having a minimum height at the central transverse plane.

* * * * *